US006848865B2

(12) United States Patent
Kadiu

(10) Patent No.: US 6,848,865 B2
(45) Date of Patent: Feb. 1, 2005

(54) SHORING DEVICE

(76) Inventor: Max Kadiu, 22113, Crows Landing, CA (US) 95313

( * ) Notice: Subject to any disclaimer, the term of this patent is extended or adjusted under 35 U.S.C. 154(b) by 0 days.

(21) Appl. No.: 10/360,240

(22) Filed: Feb. 6, 2003

(65) Prior Publication Data

US 2004/0156686 A1 Aug. 12, 2004

(51) Int. Cl.[7] ..... E02D 5/00
(52) U.S. Cl. ..... 405/272; 405/282
(58) Field of Search ..... 405/272, 282, 405/283

(56) References Cited

U.S. PATENT DOCUMENTS 3,910,053 A * 10/1975 Krings ..... 405/282
3,950,952 A * 4/1976 Krings ..... 405/282
4,657,442 A * 4/1987 Krings ..... 405/282
5,310,289 A * 5/1994 Hess ..... 405/282
5,503,504 A * 4/1996 Hess et al. ..... 405/282
6,164,874 A * 12/2000 May ..... 405/283

FOREIGN PATENT DOCUMENTS

DE 004322336 A1 * 1/1995 ..... E02D/17/08

* cited by examiner

*Primary Examiner*—Jong-Suk James Lee
*Assistant Examiner*—Lisa M. Saldano
(74) *Attorney, Agent, or Firm*—Eugene Oak

(57) ABSTRACT

A device for shoring trenches having rails, panels and articulated trusses such that pairs of opposite rails are upheld vertically by trusses and spaced along the trench to support shoring panels which slide past each other vertically within guides of adjacent rails; the rail having a back flange welded on a main rectangular tube which is provided on either side with two lateral rectangular tubes welded offset and inward past the main tube such that with a front flange welded on each lateral tube shape two vertical guides on either side of rail, the front flanges being projecting into the space between lateral tubes creating a guide contouring the edge of articulated truss which slides interlocked within; the panel being provided with special edges that interlock within vertical guides of rail, the truss being articulated and provided with roller to displace along the front flanges of the rails.

5 Claims, 3 Drawing Sheets

SHORING DEVICE

BACKGROUND OF THE INVENTION

Technical Field of the Invention

This invention relates to shoring apparatuses or devices for trenches and other similar types of open excavations employed in construction industry.

DESCRIPTION OF THE PRIOR ART

Previous trench shoring devices as disclosed in U.S. Pat. Nos. 3,910,053 and 4,657,442 (Krings), use a rail having on either side one or more channel guides. Each channel guide is of 'C' shape to interlock panels that have a 'T' shaped cross section alongside both extremities. This type of interlocking highly concentrates the stresses in the contact between rail and panel engendering damages in both rail and panels, strongly limiting the successful use of this shoring device.

The U.S. Pat. Nos. 5,310,289 and 5,503,504 (Hess et al.), disclose a rail having on either side only one channel guide for two shoring walls, created by an outer and by an inner panel. The channel guide has a 'U' shape. On backside of the guide channel a square bar interlock the outer panel within the rail. The inner panel slides not interlocked within rail presenting thereby a risk to kick in the trench when adjacent rails are not aplomb, which becomes a high safety concern when depth of excavation is over 20 ft. deep. The outer and inner panels have unequal design and are not interchangeable.

The U.S. Pat. No. 3,950,952 (Krings), U.S. Pat. Nos. 5,310,289 and 5,503,504 (Hess et al) disclose rigid strut frames of rectangular structure whose vertical members are provided with rollers. These frames have vertical members connected with horizontal struts or spreaders by bolts and slide interlocked between opposite rails. These frames are rigid and designed to take a rectangular shape only. A frame having a rectangular cell is unstable. In addition, the lower strut of the frame diminishes the pipe culvert requiring special remedial solutions for the installation of pipes of big diameters or big box culverts.

SUMMARY OF THE INVENTION

The intent of present invention is to provide a shoring device of type described above that reduce the friction and stresses in the contacts between components, while increases the safety and eases its use by having interlocked both outer and inner panels within respective guides of the rail, and allowing in addition specific features such as swing of outer and inner panels within respective guides of the rail. An important aspect of present invention is the use of common structural shapes allowing to lighten the components, ease the manufacturing process and provide better strength.

Another subject of present invention is to present an articulated truss able to adapt various technical specifications or configurations and provide a big pipe culvert as well.

The new features considered as characteristic for the invention are set forth in the appended claims. Other advantages of invention are to be appreciated in view of the following description and drawings.

DETAILED DESCRIPTION OF THE PREFERRED EMBODIMENT

Figure 1:
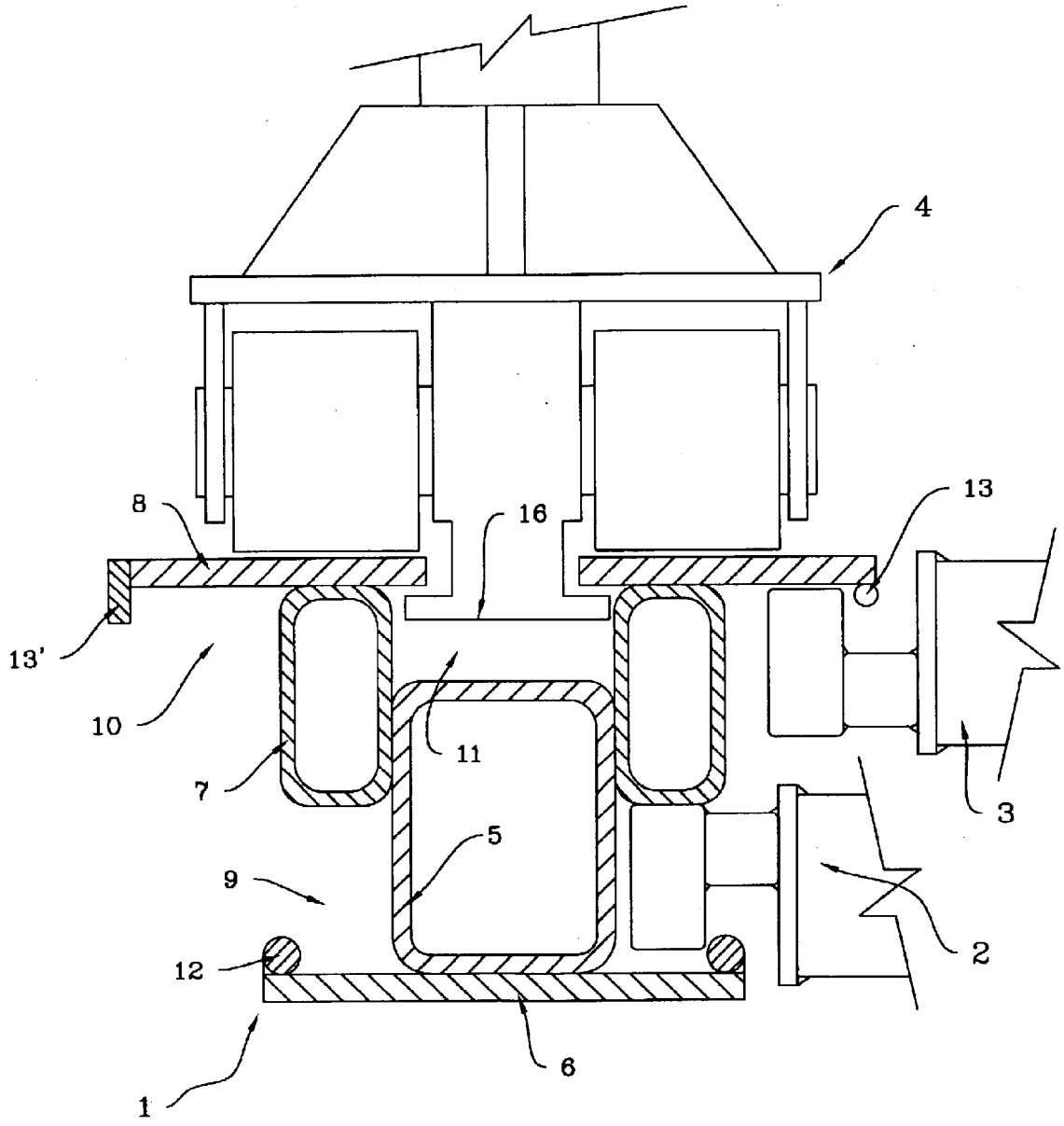
FIG. 1 is a schematic top fragmentary sectional view of the rail with the outer and inner shoring panels and the top view of vertical member of articulated truss.

Referring to the drawings, FIG. 1 illustrates a rail 1, an outer shoring panel 2, an inner shoring panel 3 and an articulated truss 4 for a trench shoring device consisting of pairs of oppositely arranged rails which are spaced along the trench, of articulated trusses sliding and guided between opposite rails, and of outer shoring panels and inner shoring panels which slide past each other between adjacent rails in the direction of the height of the trench.

The rail 1 has a main tube 5 of rectangular shape, a back flange 6 welded to the narrow side of the main tube 5 which two lateral tubes 7 of rectangular shape, welded on of the main tube 5. The space between the lateral tubes 7, the back flange 6 and the main tube 5 forms a rectangular region which serves as an outer guide 9.

Two front flanges 8 each of which are welded to the two narrow sides of the lateral tubes 7 furthest from the main tube extend in the direction of the length of the trench. The extension of the front flanges 8 outward in two opposing directions along the length of the trench in conjunction with the outer longer sides of the lateral tubes 7 forms a rectangular region which serves as an inner guide 10 for sliding inner shoring panels 3. The extension of the front flanges 8 toward one another into the gap between the main tube 5 and lateral tubes 7 creates a rectangular space which serves as a frontal guide 11, contouring to the edge 16 of the articulated truss 4. The outer guides 9 have round bars 12 welded flush to the lips of the back flanges 6 for interlocking the outer panels 2. The inner guides 10 have a strip 13' or a round bar 13 welded flush to the lip of the front flanges providing a method to interlock inner panels 3.

Figure 2:
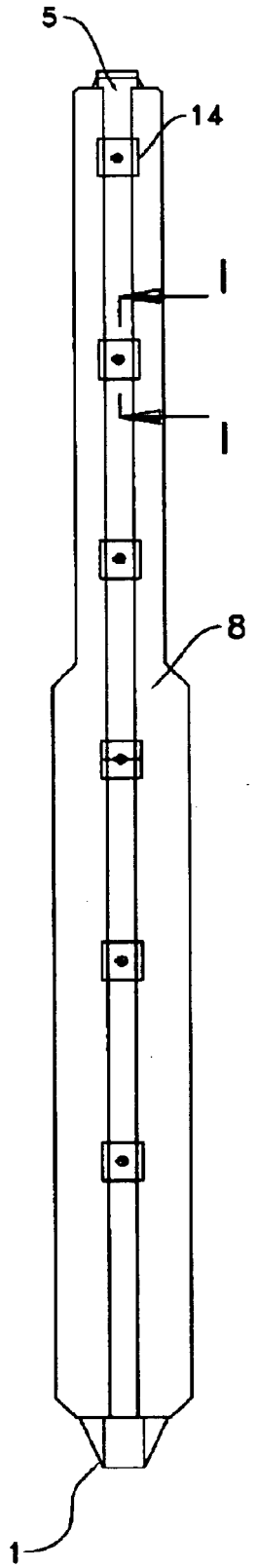
FIG. 2. shows a front view of the rail.
Figure 3:
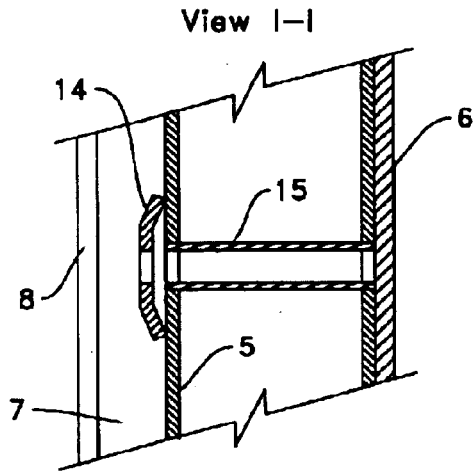
FIG. 3 is a schematic sectional view taken along the line I—I of the FIG. 2.

FIG. 2 illustrates a front view of entire rail 1 and shows that front flanges 8 are extended laterally on either side of rail 1 at the bottom half of the rail 1 only, which considerably eases the installation and removal of inner panel 3. A multitude of bent flanges 14 are welded into the main tube 5 and the lateral tubes 7. As shown in FIG. 3 the bent flanges 14 are provided with pinholes in alignment of a tube 15 which is welded between opposite walls of the main tube 5 for accepting stopping pins.

Figure 4:
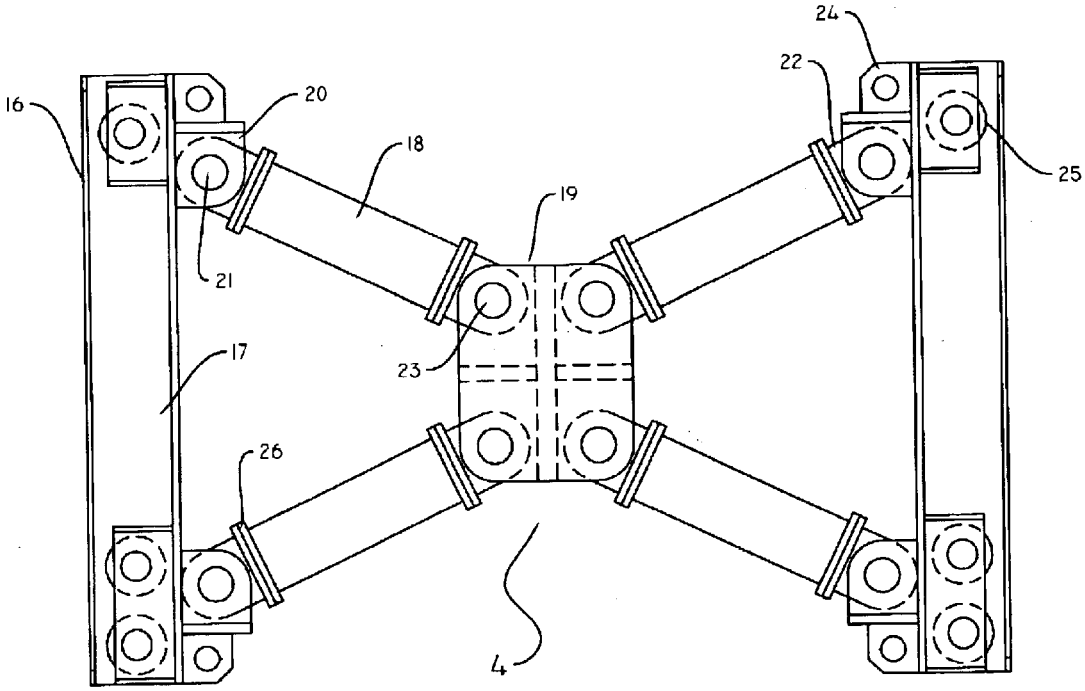
FIG. 4 shows a side view of articulated truss with all components assembled.

As shown in FIG. 4 the articulated truss 4 has the vertical members 17 where the guide edge 16 is welded for sliding within frontal guide 11 of the rail 1 (shown in FIG. 1). Vertical members 17 have upper and lower ends support flanges 20 with pine holes 21 which are connected via a pin the connector pieces 22.

Extensible members 18 could be extended by bolting successively two or more of them through contact flanges 26. Similarly, the connector pieces 22 are pinned to center piece 19 through the pin holes 23 and bolted via contact flanges 26 to an extension member 18. Depending on the shape of center piece 19 and the length of extensible members 18, several configuration of the truss are possible. For example, if the center piece 19 is omitted the extensible members 18 of the upper parts could be bolted to each other and likewise those of the lower part, creating an articulated rectangular truss. The vertical members 17 of articulated truss 4 have the lifting flanges 24 and could be provided with roller 25 at upper and lower ends for rolling in contacts on the front flanges 8 of the rail 1.

What is claimed is:

1. A trench shoring device consisting of rails, which are provided on either side thereof with an outer and an inner guide relative to interior of a trench and spaced in pairs alongside the wall of trench, of vertically mobile trusses to uphold rails of each pair of rails, and large shoring panels sliding vertically between adjacent rails within the outer and inner guides creating respectively an outer shoring wall and an inner shoring wall relative to the interior of the trench, and wherein:

the rail having a main tube of rectangular shape, a back flange welded on the narrow side of said main tube touching the wall of the trench, two lateral tubes of rectangular shape, smaller in size than said main tube, which are welded parallel on both wider sides of said main tube at a distance relative to said back flange and projecting inward past said main tube, and two front flanges each of them welded on a narrow side of said lateral tube farthest away relative to said back flange;

said back flange extending laterally in the lengthwise direction of the trench on either side of said main tube at a distance comparable to the width of said lateral tube so that an outer guide is outlined on either side along entire rail between said back flange, long side of the main tube and proximal narrow side of said lateral tube;

said back flange being provided alongside thereof with a strip or round bar welded flush to the lip of inner side relative to said outer guide so that an outer shoring panel interlocks when sliding vertically within the outer guide of the rails;

each said front flange being slightly and equally extended into a gap between lateral tubes, past said main tube, enough to shape a frontal guide of C-shape type along entire rail that contours to the guiding edge of a truss or spreader to slide interlocked within the frontal guide of the rails;

for at least the bottom half of the rail, said front flange being extended laterally in opposite directions relative to said main tube in the lengthwise direction of the trench from said lateral tube at a distance slightly bigger than the width of said lateral tube, so that an inner guide is outlined between said front flange and the longer side of said lateral tube;

each said front flange provided alongside with a strip or round bar welded flush to the lip of inner side of the front flange relative to said inner guide so that an inner shoring panel interlocks when sliding vertically within the inner guide of the rails;

said outer shoring panel and said inner shoring panel having laterally guide channels to fit the said outer guide and said inner guide of said rail;

the vertically mobile truss or individual spreader having guiding edges to fit the said frontal guide of the rail to slide interlocked within the frontal guide of the rails;

said articulated truss or said individual spreader provided with roller to displace vertically along said front flanges of said rail.

2. A trench shoring device as set forth in claim 1, wherein said rail is provided with at least bent steel plate that has at center a hole, said bent plate being inserted into said frontal guide and welded onto said lateral tubes and said main tube.

3. A trench shoring device as set forth in claim 1, wherein said rail further including at least one round tube, said round tube being on alignment of the pin hots of at least one of said bent plate, traversing front and back side of said main tube.

4. An articulated truss according to claim 1, having two identical vertical members, at least four inclined extensible members provided at extremities with contact flanges, one center piece and a multitude of pin connector pieces wherein;

said vertical member having alongside a guiding edge of T-shape fitting the said frontal guide of said rail, at least two supporting pin connectors located at upper and lower extremities of said vertical member, said supporting pin connector being formed by at least one flange outlining a quarter of circle and provided with a pin hole;

said extensible members being of structural tube of rectangular or round shape and having at least four screw holes on said contact flanges;

said center piece being formed by two rectangular large flanges spaced from each other by at least two supporting flanges perpendicular to each other and welded on said large flanges, said large flanges having each corner rounded and provided at center of arc with a pin hole, said pin connector piece being formed by two flanges having a semi-circle shape and provided with a pin hole, welded onto said contact flange, each pin connector piece bolted on each extremity of every extensible member so that each said extensible member is connected by pins via a said connector piece on one side to said support connector of said vertical member and the other side of extensible member connected by pins via connector pieces to said pin holes of said center piece.

5. An articulate truss as set forth in claim 4, wherein supports with rollers are provided at upper and lower ends of each said vertical member.

* * * * *